United States Patent [19]

O'Connor et al.

[11] 4,003,196

[45] Jan. 18, 1977

[54] SOLID STATE LADIES' WRISTWATCH

[75] Inventors: Arthur Herman O'Connor; Robert Eugene McCullough, both of Lancaster, Pa.

[73] Assignee: Time Computer, Inc., Lancaster, Pa.

[22] Filed: Sept. 10, 1974

[21] Appl. No.: 504,770

[52] U.S. Cl. ..... 58/4 A; 58/58; 58/91

[51] Int. Cl.[2] ..... G04B 19/24; G04B 39/00

[58] Field of Search ..... 58/4 A, 23 R, 50 R, 58/58, 91, 152 R

[56] References Cited

UNITED STATES PATENTS

| | | | |
|---|---|---|---|
| 2,115,359 | 4/1938 | Cohen | 58/127 R |
| 2,830,434 | 4/1958 | Trautz | 58/91 X |
| 3,672,155 | 6/1972 | Bergey et al. | 58/50 R |
| 3,813,533 | 5/1974 | Cone et al. | 58/50 R |
| 3,838,566 | 10/1974 | O'Connor et al. | 58/50 R |
| 3,846,971 | 11/1974 | Ho et al. | 58/50 R |

*Primary Examiner*—E. S. Jackmon
*Attorney, Agent, or Firm*—LeBlanc & Shur

[57] ABSTRACT

Disclosed is a solid state wristwatch of small size particularly adapted for use as a ladies' watch. A plurality of small individual display stations formed of light emitting diodes are mounted on one side of a laminar ceramic substrate. The stations are viewed through a window formed of hardened red glass arcuately curved in the direction of the long dimension of the display. The watch case or bezel is similarly curved to conform to the window providing a more pleasing appearance and to conserve space.

18 Claims, 25 Drawing Figures

FIG. 12
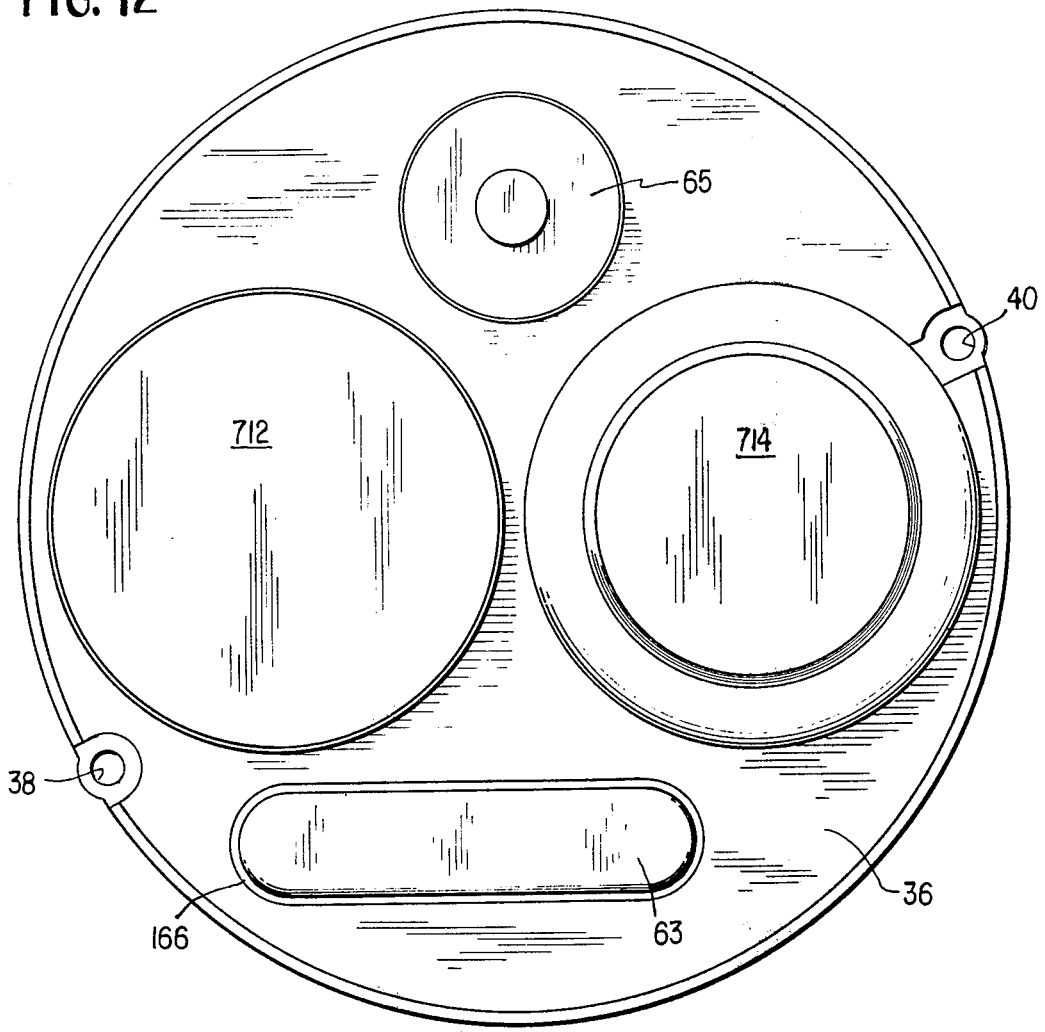
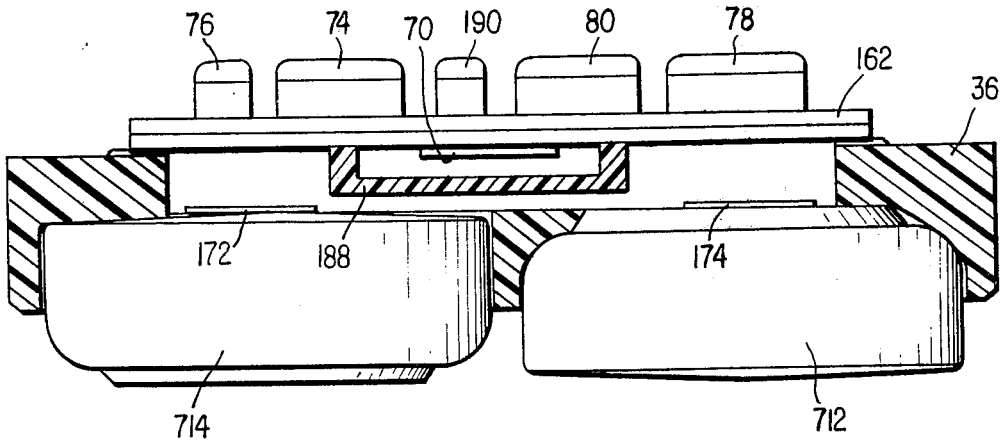
FIG. 13

FIG. 24
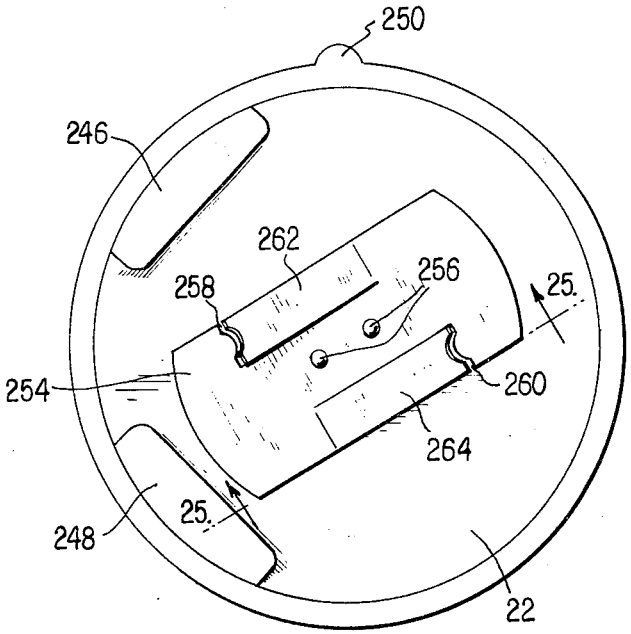
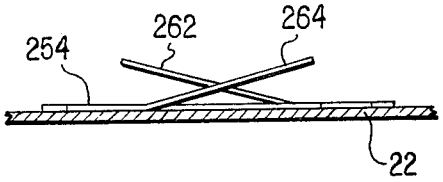
FIG. 25

SOLID STATE LADIES' WRISTWATCH

This invention relates to improvements in the wristwatch construction disclosed in U.S. Pat. No. 3,803,827 and in copending application Ser. No. 504,734 filed Oct. 10, 1974, and entitled SOLID STATE WATCH WITH INERTIAL SWITCH both of which are assigned in common with the present application.

This invention relates to a solid state timepiece and more particularly to a light-emitting diode type electronic wristwatch which employs substantially no moving parts. In the present invention, a frequency standard in the form of a crystal oscillator acts through solid state electronic circuit dividers and drivers to power in time sequence the light emitting diodes of an electro-optical display. In particular, the present invention is directed to a wristwatch having improved features particularly suited for incorporation in smaller men's and especially in ladies' wristwatches.

Battery powered wristwatches and other small portable timekeeping devices of various types are well known and are commercially available. The first commercially successful battery powered wristwatch was of the electromechanical type shown and described in U.S. Pat. No. Re. 26,187, reissued Apr. 4, 1967 to John A. Van Horn et al for "Electronic Watch."

In recent years, considerable effort has been directed towards the development of a wristwatch which does not employ an electromechanical oscillator as the master time reference. For example, in assignee's U.S. Pat. No. 3,560,998 issued Feb. 2, 1971, there is shown a wristwatch in which the master time reference is formed by a high frequency oscillator connected to the watch display through a divider made of low power, complementary MOS transistor circuits. In assignee's U.S. Pat. No. 3,567,099, issued Apr. 27, 1971, there is disclosed a watch construction in which the optical display is described as a plurality of light-emitting diodes which are intermittently energized to assure minimum power consumption and an increasingly long life for the watch battery Improved watch constructions of this general type incorporating solid state circuits and integrated circuit techniques are disclosed in assignee's U.S. Pat. Nos. 3,672,155, 3,760,584, 3,742,699, 3,759,031, and others.

The present invention is directed to an improved wristwatch construction of the same general type as disclosed in the above-mentioned applications and patents but one which is smaller in size and therefore particularly adapted for use as a ladies' wristwatch. In particular, the wristwatch construction of the present invention makes possible a wristwatch that is smaller both in length in width, as well as thickness, and one which has an improved and more attractive configuration. As a result, the watch construction of the present invention is particularly adapted for incorporation into the smaller size men's wristwatch cases and is especially adapted to the construction of a ladies' wristwatch. The reduction in size is effected in the construction of the present invention while, at the same time, maintaining the reliability, ease of maintenance, ease of manufacture, increased shock and impact resistance, and excellent accuracy of assignee's previous constructions.

In the present invention, a frequency standard in the form of a crystal controlled oscillator is coupled through an integrated circuit frequency divider and display actuator to an electro-optical digital display in the form of a plurality of light-emitting diodes. The diodes are viewed through a transparent window which, in the improved form of the present invention, comprises a curved and preferably a hard-glass, optical filter for passing the red light from the display while, at the same time, enhancing contrast for increased readability. Mounted in the wristwatch case is a rugged, impact-resistant, one-piece frame which houses the entire wristwatch assembly including the wristwatch battery. Secured in the rear side of the module frame are a pair of battery cells and an oscillator trimmer capacitor so that ready access may be had to these cells and the trimmer by removal of the watch case back. Also mounted on the frame is a single large-scale integrated circuit chip combining both a timekeeping and calendar CMOS circuit. Also on the frame is the electro-optical LED display, related circuit components and the electrical interconnections. The frame further carries an oscillator crystal, a pair of demand switches and a pair of setting switches. The two demand switches are used to alternatively energize the light-emitting diode display to indicate either time or calendar information. The setting switches are for setting the time and calendar displays.

The watch display is visible through a red-colored filter, and is formed from a plurality of light-emitting diodes which are preferably arranged in a seven-bar segment array. The light-emitting diodes are energized in appropriate time relationship with an effective brightness determined by an intensity control circuit utilizing a photosensitive detector. Situated on one side of the watch is a pushbutton demand switch which, when depressed, instantly activates the appropriate visual display stations. Minutes and hours are programmed to display for 1¼ seconds, with just a touch of the demand switch. Continued depression of the demand switch causes the minutes and hours data to fade and the seconds to immediately appear. The seconds continue to count as long as the operator depresses the demand switch. Computation of the precise time is continuous and completely independent of whether or not time is displayed.

Setting is accomplished by actuating either an hour set switch or a minute set switch, both of which as with the demand switches, are preferably magnetic field responsive reed switches. The hour set switch rapidly advances the hours without disturbing the timekeeping of the minutes and seconds. Actuation of the minute set switch automatically zeros the seconds while advancing the minutes to the desired setting. Calendar or date information is displayed by depressing a second demand button on the other side of the wristwatch case and the calendar information, namely day-of-the-month and month-of-the year in numerical form, as well as the A.M. or P.M. of time is displayed when the second demand button is depressed.

The date or calendar circuit automatically counts to 30 or 31 days, according to the month of the year, and further automatically counts to 29 in February. The time read or first demand switch and the hour set switch are used in conjunction with the date switch to set the calendar. When the hours are set in the watch, the A.M./P.M. of the calendar is automatically reset at A.M. without changing the date. To set the days, the second demand switch, or date switch, is depressed so that the date is shown on the display and then the read or time demand switch is depressed and the setting magnet placed in the hours set slot. Days are advanced at one day a second and, at the same time, the A.M./P.M. indication is advanced at the rate of 2 Hz. When the first demand switch is released, the days stay set at the desired date and at the desired A.M. or P.M. To set the month, the second demand switch (date demand) is depressed to display the date. The hours set switch is then closed to run the month at 2-months-a-second rate. When the hour set switch is reopened, the month is set as desired. The display always shows the date, both day and month, in numerical form everytime the date switch is closed and this display preferably is programmed for 1¼ seconds in the same manner as the time display.

Important features of the present invention include a unitary timing assembly in which the light-emitting diode display elements are mounted on a ceramic substrate, as are the other discrete active components forming the watch electrical circuit. The entire assembly including display, electrical components and wiring, along with the integrated circuit chip, are potted preferably by coating the assembled elements with a suitable transparent material such as clear epoxy. The result is a relatively thin compact structure which can be significantly reduced in size without sacrificing any of the desirable characteristics of previous constructions, so that it is suitable for use in the smaller sizes as is customarily required for a ladies' wristwatch.

A further important feature of the present invention resides in the provision of a novel case construction, particularly distinguished by a curved transparent light filter conforming to the overall curved nature of the watch case. Such a construction importantly contributes to the pleasing overall appearance of the wristwatch while, at the same time, making optimum use of available space in a small size or ladies' wristwatch. In the preferred embodiment, the filter is arcuately curved about only one axis, which axis lies in the conventional 6 o'clock to 12 o'clock vertical plane through the center of the wristwatch. By so curving the light filter and adjacent portions of the watch case improved design configurations and optimum utilization of space are both obtained without any accompanying distortion in the display, significant loss of illumination, or reduction in contrast. It has been found that by limiting the radius of curvature of the display filter about a single axis to a value no less than about 1.6 inches, the advantages described above are obtained without any loss in readability of the display diodes.

It is therefore one object of the present invention to provide an improved electronic wristwatch.

Another object of the present invention is to provide an improved solid state wristwatch of relatively small size.

Another object of the present invention is to provide an improved solid state wristwatch particularly adapted for use as a ladies' watch.

Another object of the present invention is to provide a solid state wristwatch having a light-emitting diode display in which the watch exhibits an improved optical filter and wristwatch case construction.

Another object of the present invention is to provide a ladies' wristwatch construction which takes optimum advantage of available space while, at the same time, permitting greater flexibility in design configuration.

Another object of the present invention is to provide a light-emitting diode wristwatch in which the optical filter is arcuately curved about an axis lying in the 6-12 o'clock vertical plane of the wristwatch.

Another object of the present invention is to provide a wristwatch of the solid state type which is small in both length and width and which is relatively thin.

These and further objects and advantages of the invention will be more apparent upon reference to the following specification, claims and appended drawings, wherein:

FIG. 12 is a bottom plan view of the movement of FIG. 10;

FIG. 13 is a cross section through the movement of FIG. 10 taken at right angles to that of FIG. 11;

FIG. 24 is an inside view of the watch case back of FIG. 23; and

FIG. 25 is a partial cross section taken along line 25—25 of FIG. 24.

Figure 1:
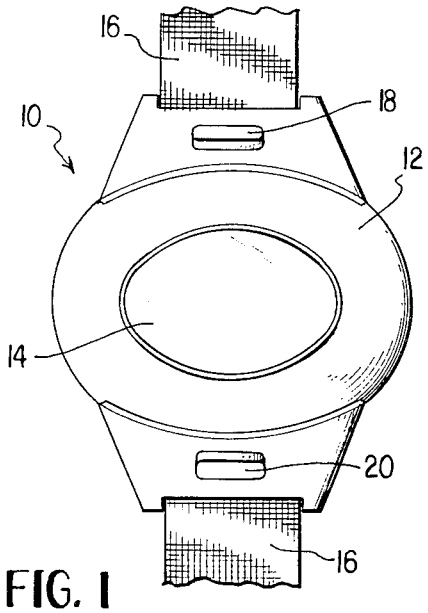
FIG. 1 is a plan view of a ladies' wristwatch and a portion of a wristwatch bracelet constructed in accordance with the present invention.

Referring to the drawings, FIG. 1 is a perspective view of a ladies' wristwatch constructed in accordance with the present invention. The wristwatch, generally indicated at 10, comprises a non-magnetic watch case 12, having a viewing window 14. The window is formed as a curved section of preferably hardened red glass to form a red light filter as more fully described below. Attached to case 12 is a wristwatch band 16 and mounted on the case is a pushbutton time demand switch 18. Also mounted on the watch case at the edge opposite from the time demand switch is a similar date demand switch 20. Pushbutton switches 18 and 20 are of identical construction and carry permanent magnets so that when they are depressed, reed switches inside the watch case are actuated. Both demand switches may be of the type described in assignee's U.S. Pat. No. 3,782,102, but preferably take the form shown and described in copending application Ser. No. 481,331, filed June 20, 1974, the disclosure of which copending application is incorporated herein by reference.

Figure 2:
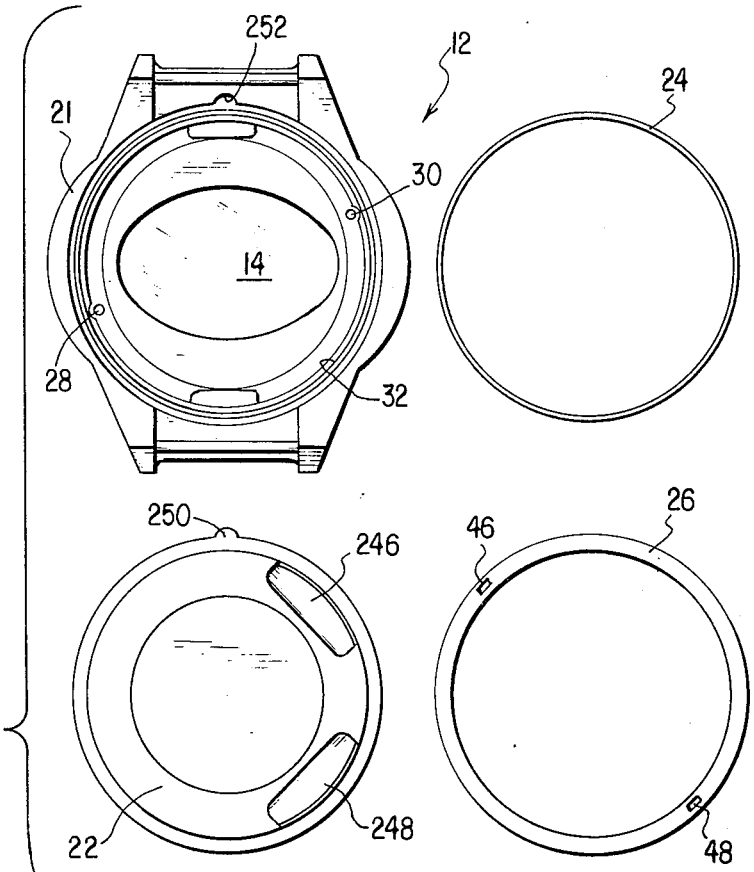
FIG. 2 is an exploded view showing the principal components of the watch case forming a part of the ladies' wristwatch of FIG. 1.

FIG. 2 is an exploded view showing the components of the watch case 12. These comprise a bezel or cover 21 mounting the red light filter 14, a back plate 22, an O-ring sealing gasket 24, and an externally threaded attachment ring 26. Bezel 21 is provided with a pair of mounting holes 28 and 30 which extend only partway through the bezel and which are adapted to receive the ends of mounting screws for mounting a module frame inside the case bezel 21. The bezel is internally stepped as at 32 to receive the sealing ring and is internally threaded so as to engage with the external threads on attachment ring 26. Sealing ring 24 is first placed on the stepped surface of the bezel and the back plate 22 placed over it. The back plate is tightened down by threading the attachment ring 26 into the bezel where it overlies the outer edge of the back plate.

Figure 3:
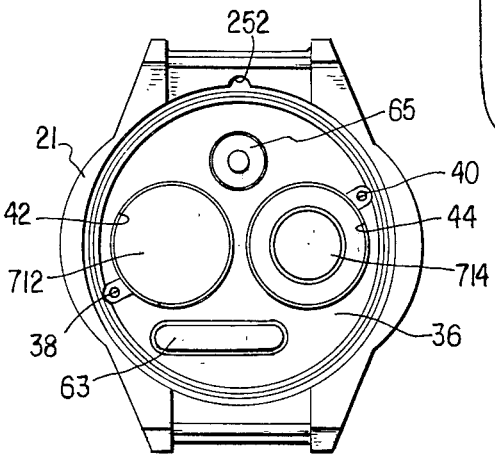
FIG. 3 illustrates the watch case of FIG. 2 with the watch frame inserted in the case.

FIG. 3 shows the bezel 21 with a module frame of circular configuration illustrated at 36 as completely received within the bezel. Frame 36 is attached to the bezel solely by a pair of mounting screws 38 and 40 which pass through the frame and are threadedly received in the mounting holes 28 and 30 of FIG. 2. Frame 36 is provided with a pair of circular cavities 42 and 44, each of which is adapted to receive a 1½ volt one-cell battery. The batteries are connected in series to form a battery power supply of 3 volts.

Figure 4:
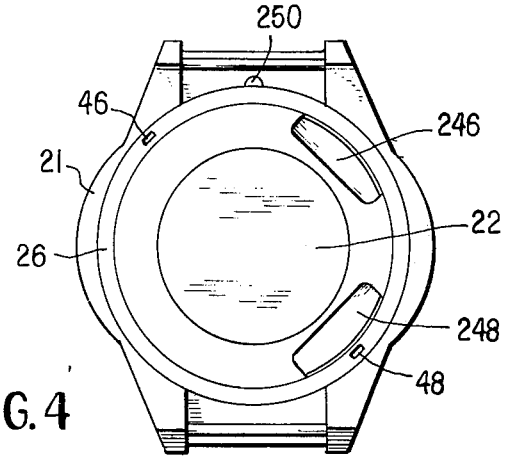
FIG. 4 is a rear plan view of the watch of FIG. 1 showing the watch case completely assembled.

FIG. 4 is a bottom plan view of a completely assembled watch case. As illustrated in FIG. 2, ring 26 is preferably provided with a pair of diametrically opposed indentations 46 and 48 adapted to be engaged by the ends of a bifurcated tool, so that the ring may be rotated to tighten the assembly. In assembling the watch, frame 36 is first inserted into the bezel 21 and secured by the screws 38 and 40. O-ring seal 24 is then inserted onto the step 32 in the bezel and the back plate 22 is placed over the O-ring seal. Finally, attachment ring 36 is placed so that it overlies the outer edge of the back plate and the ring is rotated into tight threaded engagement with the internal threads 34 on bezel 21. The screws 38 and 40 automatically angularly orient or align the frame 36 with the bezel 21 and the viewing window 14. Back plate 33 is preferably also provided with an alignment tab 250 (FIG. 2) which slides into a shallow groove 252 in the bezel so that the back plate is also automatically aligned with the bezel. Only attachment ring 26 is rotated to tighten the back plate to the bezel and compress sealing ring 24.

Figure 5:
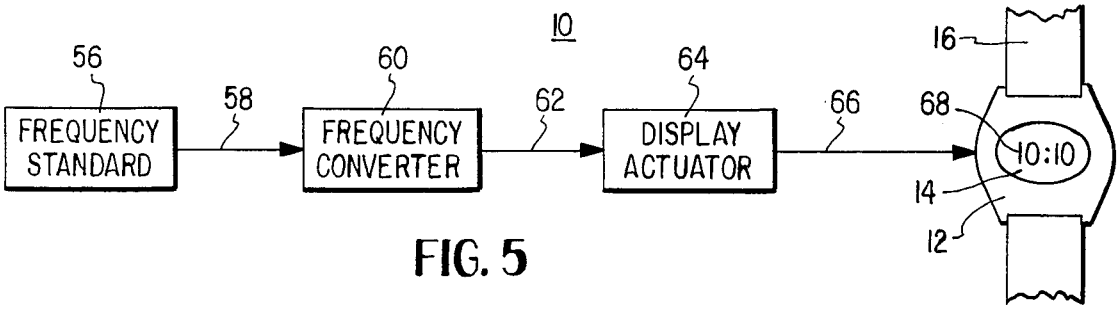
FIG. 5 is a simplified block diagram of the electrical circuit for the timekeeping portion of the wristwatch of this invention.

FIG. 5 is a simplified block diagram of the principal time-keeping components of the watch of the present invention. These comprise a time base of frequency standard 56, preferably in the form of a crystal oscillator producing an electrical output on lead 58 at a frequency of 32,768 Hz. This relatively high frequency is supplied to a frequency converter 60 in the form of a divider which divides down the frequency from the standard 56, so that the output from the converter 60 appearing on lead 62 is at a frequency of 1 Hz. This signal is supplied to a display actuator 64 which in turn drives an electrooptical display indicated at 68 and viewable through window 14 by way of electrical lead 66. While only an hours and minutes display is shown in FIG. 5, it is understood that with the operation of the pushbutton 18 of FIG. 1, the hours and minutes are first displayed for a predetermined time and if the pushbutton 18 remains depressed, the hours and minutes are extinguished and the seconds become visible. The same display diodes are used for both minutes and seconds since these are not displayed simultaneously, thus minimizing the power drain from the watch battery.

In normal operation, time is continuously being kept but is not displayed through the window 14. That is, no indication is visible through the window and this is the normal condition which prevails in order to conserve battery energy in the watch. However, even through the time is not displayed through the window 14, it is understood that the watch continuously keeps accurate time and is capable of displaying this time at any instant. When the wearer or operator desires to ascertain the correct time, she depresses the pushbutton 18 with her finger and the correct time is immediately displayed at 68 through window 14 which shows a light-emitting diode display giving the correct time reading of 10:10, namely 10 minutes after 10 o'clock. The hours and minutes are displayed through the window 14 for a predetermined length of time, preferably 1¼ seconds, irrespective of whether or not the pushbutton 18 remains depressed. The exact time of the display is chosen to give the wearer adequate time to consult the display to determine the hour and minute of time. Should the minutes (or hours) change during the time display, this change is immediately indicated by advancement of the minute (or hour) reading to the next number, i.e., 10:11, as the watch is being read. If the pushbutton 18 remains depressed at the end of 1¼ seconds, the hours and minutes of the display are extinguished, i.e., they disappear and simultaneously the seconds reading is displayed through the window 14 by the same diodes which previously displayed the minutes. The advancing seconds cycling from 0–59 continue to be displayed through window 14 until the pushbutton switch 18 is released.

Pushbutton 18 acts as a read switch or a demand switch which is depressed when the wearer desires the time to be displayed. Incorporated in the watch 10 of FIG. 1 is a second pushbutton switch 20, identical in construction and hereafter referred to as the date switch. When the pushbutton of the date switch is depressed, the day of the month, month of the year, and the A.M. or P.M. of time are displayed by the same diodes that display time in response to depression of pushbutton 18. This calendar information may, if desired, be displayed so long as button 20 remains depressed and immediately extinguished when the date button 20 is released. However, in the preferred embodiment, the date display is programmed for 1¼ seconds in exactly the same manner as the time display described above. That is, when button 20 is momentarily depressed, the day, month and A.M. or P.M. of time will remain on for 1¼ seconds, irrespective of whether or not the button remains depressed. If button 20 continues to be depressed after 1¼ seconds, the day, month and A.M. or P.M. of time (calendar information) continue to be displayed until the button 20 is released.

Figure 6:
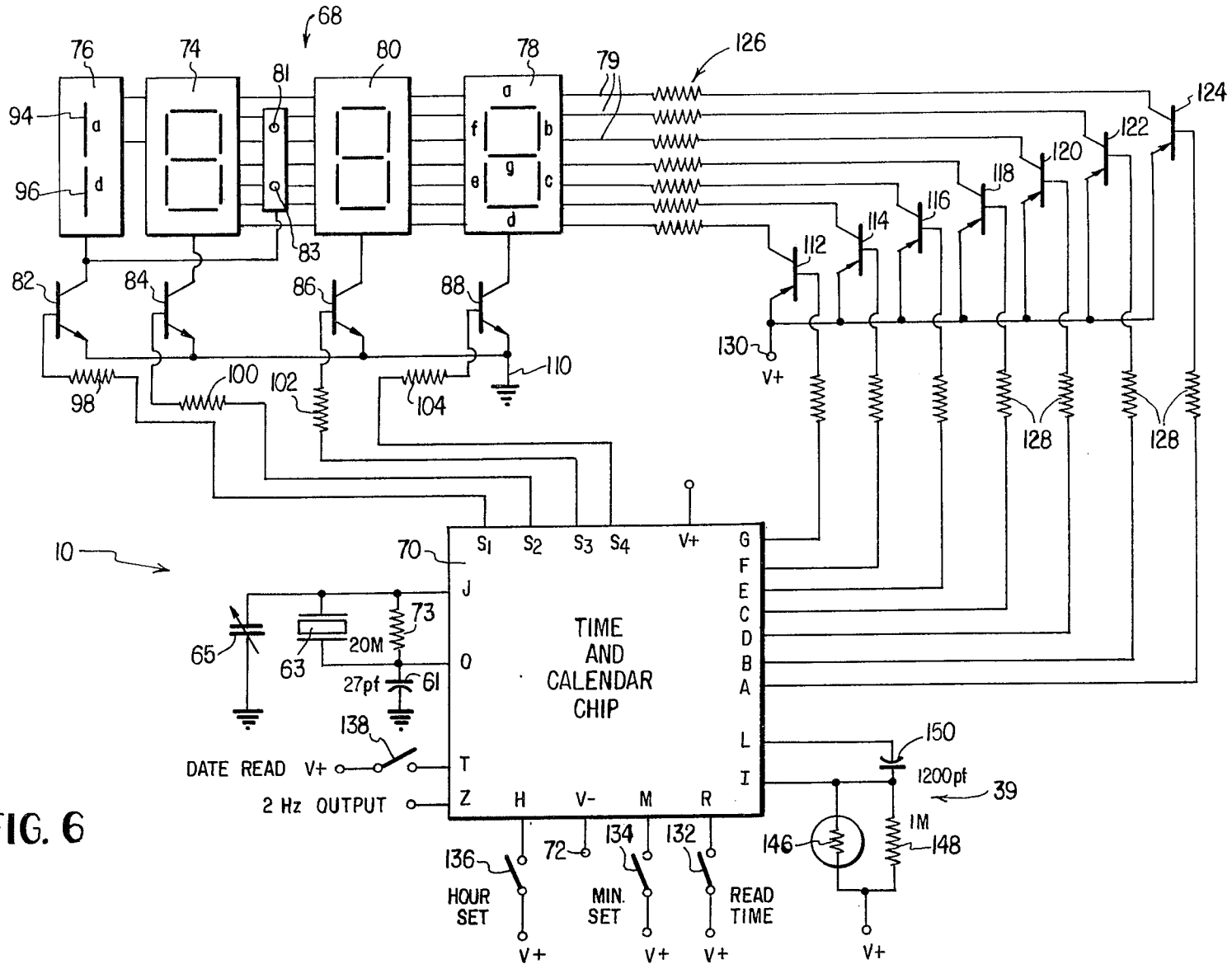
FIG. 6 is an overall electrical circuit diagram of the watch of the present invention showing the large scale integrated CMOS single-chip circuit in block form.

FIG. 6 is an overall circuit diagram of the wristwatch of this invention. The watch comprises a large scale, integrated circuit 70, preferably in the form of a single integrated circuit chip formed entirely of complementary symmetry MOS transistors. Circuits of this type are presently available from RCA, Hughes Aircraft Corporation, and others. For a detailed disclosure of the components and manner of operation of the time and calendar chip 70, reference may be had to assignee's copending application Ser. No. 504,734, filed Oct. 10, 1974, the disclosure of which is incorporated herein by reference. In addition to the large scale integrated circuit 70, the watch comprises the battery cells of FIG. 3 connected to the negative battery terminal 72 labeled V− and to the positive battery terminals in FIG. 6 labeled V+. The battery energizes the light-emitting diode display 68 which is shown in FIG. 6 as consisting of a pair of hours stations comprising the digits station 74 and tens station 76 and a pair of combination minutes and seconds stations comprising the digit station 78 and the tens station 80. The display 68 also includes a pair of colon dots (:) 81 and 83, each formed by a single light-emitting diode. Station 78 is formed of a seven-bar segment array including the light-emitting diode segments labeled *a* through *g*. Stations 74 and 80 are of identical construction, whereas the hours tens station 76 is formed from two light-emitting diode bar segments 94 and 96. The display stations are energized from integrated circuit chip 70 by way of a plurality of leads 79 to the anodes of the light-emitting diodes and the cathodes of the light-emitting diodes are individually connected to the other side of the power supply through a four-transistor array of strobing or switching NPN junction transistors 82, 84, 86 and 88. These transistors are referred to as the station drivers. There is a separate lead 79 for the total number of bar segments in a display station, and these leads are connected to a corresponding *a* through *g* segment of each of the stations 74, 78 and 80. That is, with a seven-bar segment display, there are seven leads 79. However, all the cathodes of each station are connected in common through the NPN junction transistor for that station. The two bar segments 94 and 96 for the hours ten display have cathodes connected to the transistor 82 as do the colon dots (:) 81 and 83. All the cathodes of the hours unit station 74 are connected to a transistor 84. Display stations 78 and 80 are used to display both minutes and seconds and station 80 has the cathodes of all diodes connected to the transistor 86 and all the cathodes of display station 78 are similarly connected to transistor 88. These transistors have their bases returned to the integrated circuit chip 70 through current limiting resistors 98, 100, 102 and 104, the emitters of the transistors being connected in common to ground, i.e., the negative side of the power supply battery as indicated at 110.

The anodes of the bar segment diodes are energized from the bipolar driver transistors 112, 114, 116, 118, 120, 122 and 124. Since the greatest number of bar segments in any display station is seven, there are seven segment driver transistors and seven leads 79. The transistor collectors are connected to the display diodes through individual ones of current limiting resistors 126 and the driver transistor bases are connected to integrated circuit chip 70 through protective resistors 128. The emitters of the driver transistors are connected in common to the positive side 130 of the power supply battery. The PNP segment driver transistors are preferably formed from a transistor array as are the NPN station drivers.

The crystal oscillator or frequency standard 56 of FIG. 5, by way of example only, may be of the type disclosed in assignee's U.S. Pat. No. 3,760,584. The components of this oscillator in FIG. 6 external to the large-scale integrated circuit 70, are the crystal 63, the variable capacitor 65, (tuning capacitor or trimmer), bias resistor 73, and a fixed grounded capacitor 61. The active components of oscillator 56 are incorporated into integrated circuit 70 as more fully described below. Also external to the integrated circuit is a demand or time read switch 132 which is closed when the button 18 of FIG. 1 is depressed. Further manually operated switches external to the integrated circuit 70 are the minute set switch 134 and hour set switch 136. These switches are connected between the positive side of the battery and the time computer circuit chip 70.

In the watch of the present invention, the intensity of the light emitted from the display diodes is varied in accordance with ambient light. That is, the diode light intensity is increased for greater contrast when ambient light is bright, such as during daytime display, whereas the intensity of the light from the diodes is decreased when ambient light decreases. The automatic display intensity control circuit is generally indicated at 39 in FIG. 6 and comprises a photosensitive resistor 146 suitably mounted on the face of the watch connected to the positive side of the battery and to a resistor 148 and a capacitor 150. Finally, an additional switch external to integrated circuit chip 70 is the date switch 138 which is closed in response to depression of the button 20 of FIG. 1.

Figure 7:
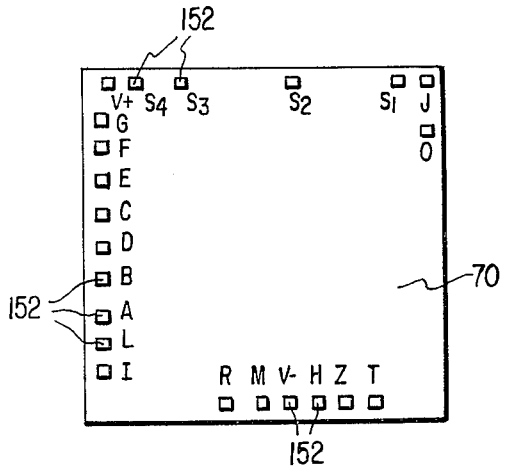
FIG. 7 is a rear view of the integrated circuit chip forming a part of the circuit of FIG. 6.

FIG. 7 is a plan view showing the underside of the time and calendar chip 70. The terminals of FIG. 6 are formed by the correspondingly labeled bonding pads 152 in FIG. 7 to which external leads are wire bonded in the complete assembly. As indicated in FIG. 7, the overall length of the circuit chip is approximately 0.120 inch, and the overall width is approximately 0.115 inch. As can be seen from these dimensions, the chip takes up very little space and can be readily incorporated into a ladies' wristwatch case.

Figure 8:
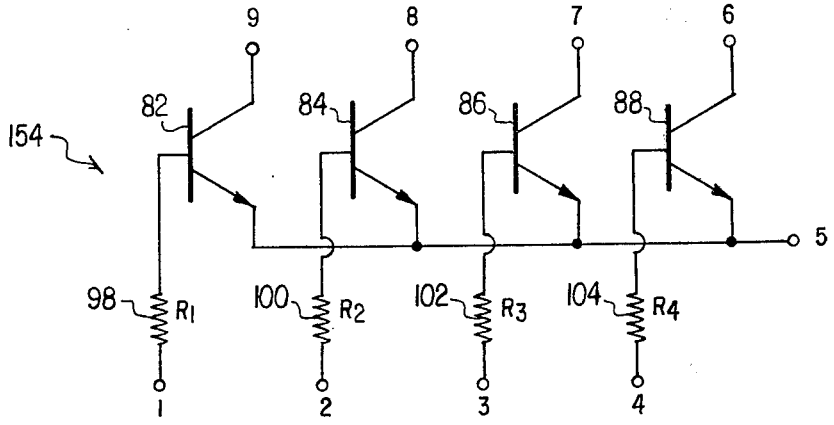
FIG. 8 is a circuit diagram of the digit driver array forming a part of FIG. 6.

FIG. 8 shows the transistor array 154 forming the digit or station drivers and their associated resistors. This array comprises four matched transistors and four matched resistors connected to individual ones of the transistor bases. The transistors and resistors are all formed on the same substrate so as to have as similar as possible operating characteristics and temperature responses.

Figure 9:
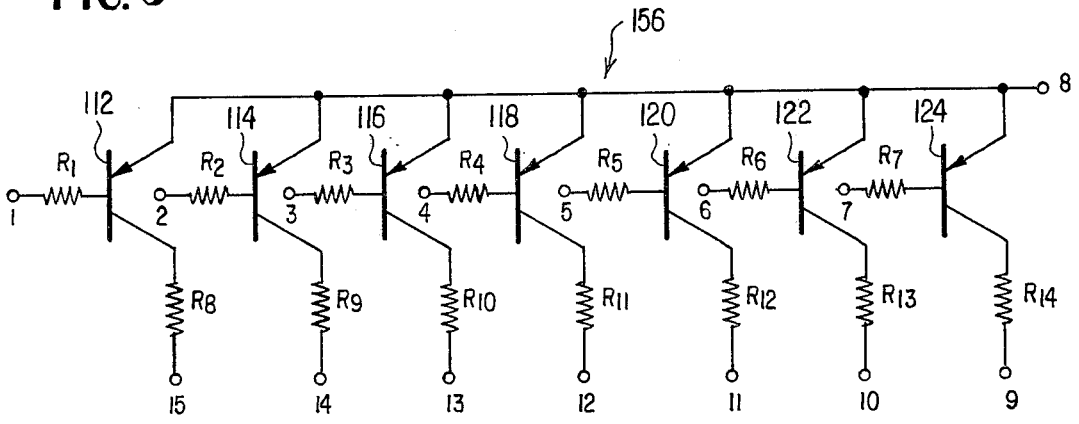
FIG. 9 is a circuit diagram of the segment driver array forming a part of FIG. 6.

FIG. 9 shows the array 156 formed by the segment driver transistors of FIG. 6. Again, the transistors which in this case are PNP transistors, along with their associated collector and base resistors, are all formed on the same substrate to have matching operating characteristics and temperature responses. The operating temperature range for both arrays 154 and 156 is from −20° to +85° C with a storage temperature range of from −40° to +130° C. Typical values for the base resistors in each array is 2.1 kilohms with the resistors tracking each other within 5% and a typical value for each of the collector resistors in array 156 is 107 ohms, again with the resistors tracking each other within five percent.

Figure 10:
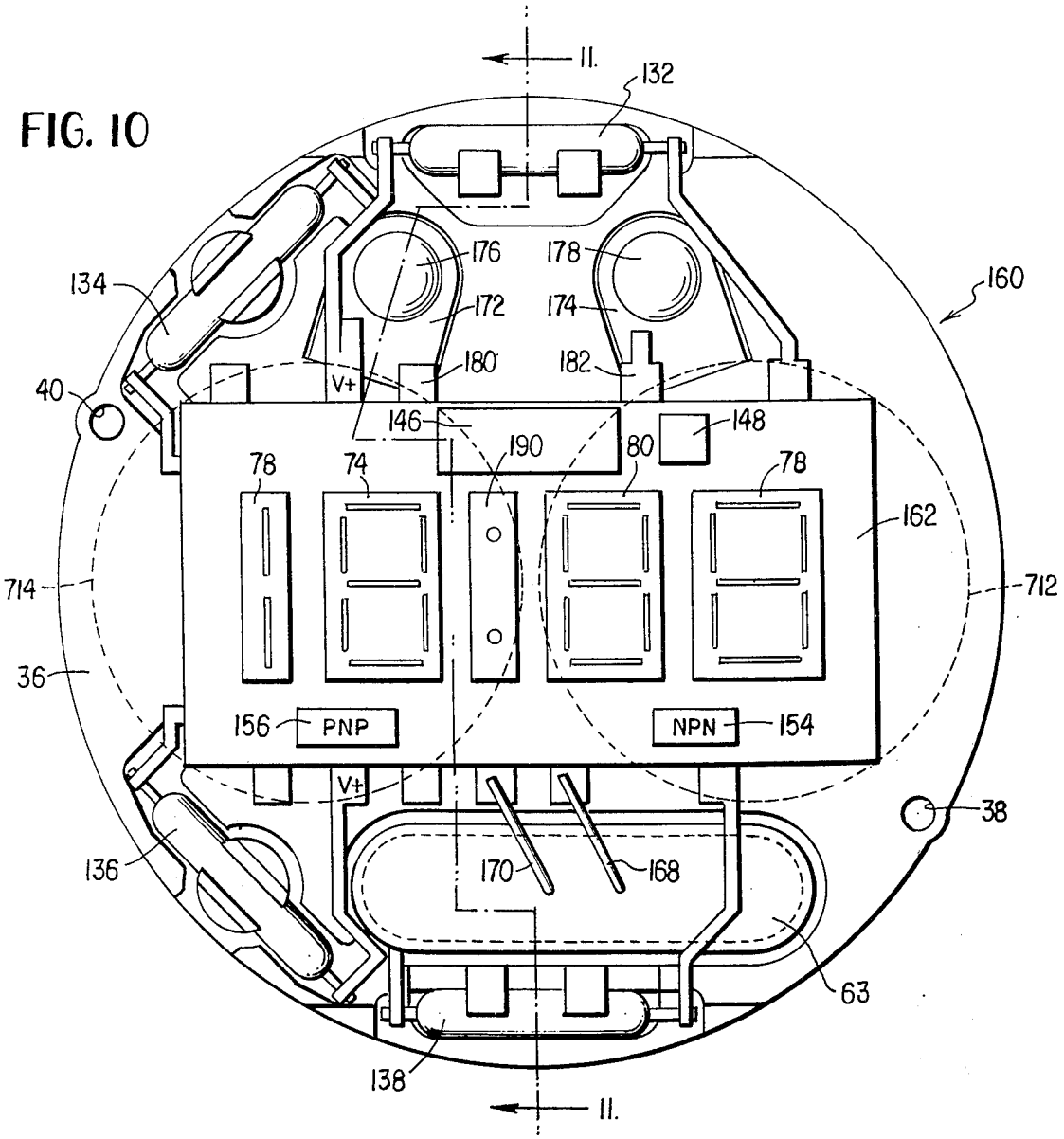
FIG. 10 is a top plan view of the watch movement of the present invention.
Figure 11:
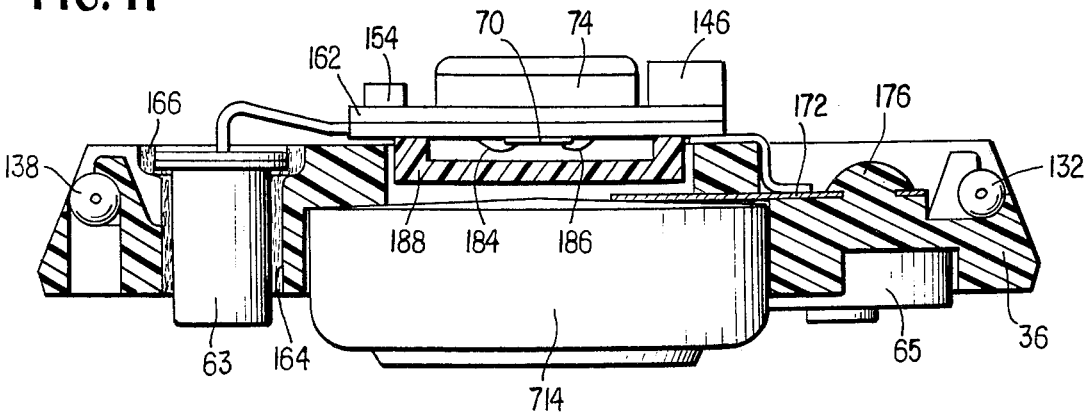
FIG. 11 is a cross section taken along line 11—11 of FIG. 10.

FIG. 10 is a front plan view of the watch module or movement 160 including the frame 36 of FIG. 3. FIG. 11 is a cross section taken along line 11—11 of FIG. 10, FIG. 12 is a rear or bottom view of the movement of FIG. 10 and FIG. 13 is a cross section through the movement taken at a right angle to that of FIG. 11.

The module 160 comprises the generally circular module frame 36, preferably formed from an impact-resistant, one-piece, injection molded plastic material and in the preferred embodiment is S-2/30 type 6-10 Nylon which is a fiber-filled, electrically insulating nylon material. The frame 36 is of circular or disc-shape, one-piece plastic construction and mounted on the front of the frame is a ceramic substrate 162. The front surface of the module frame 36 is recessed to receive four reed switches, namely the date demand switch 138, the time demand switch 132, minute set switch 134, and hour set switch 136. A portion of the frame 36 is apertured as at 164 as best seen in cross section in FIG. 11, to receive the piezoelectric crystal 63. The crystal is preferably encased as illustrated in a silicon rubber potting compound 166 which acts as an adhesive to secure the crystal in the module frame and to support it against excessive vibration. The crystal is provided with a pair of electrical leads 168 and 170 for making electrical connection to the remainder of the circuit. FIGS. 12 and 13 show the two battery cells 712 and 714. Each of the cells is a conventional 1½ volt wristwatch battery cell and they are connected in series to provide a three-volt power supply. The batteries make contact with a pair of resilient battery terminals 172 and 174 in a manner best seen in FIG. 11. These are staked to projections 176 and 178 forming a part of the frame.

Frame 36 has its back surface recessed to receive the trimmer capacitor 65. A pair of trimmer leads 180 and 182 pass completely through the frame and are secured to terminals 172 and 174. By way of example only, trimmer capacitor 65 may be of the type manufactured by the Johanson Manufacturing Corporation of Boonton, N.J. Read switches 132, 134, 136 and 138 may be of the type more fully shown and described in assignee's U.S. Pat. No. 3,714,867 and are actuated in response to the influence of the magnetic field of a permanent magnet moved into an area adjacent the particular switch to be actuated.

Ceramic substrate 162 mounted on the frame, has secured to its underside the integrated circuit chip 70 as best seen in FIGS. 11 and 13. This chip is wire bonded to the remainder of the circuit as indicated by leads 184 and 186 in FIG. 11. It is protected by a cover 188 of plastic or other suitable material also secured to the underside of the ceramic substrate 162. Secured to the upper or front side of substrate 162 are the four display stations 74, 76, 78 and 80, as well as the station 190 carrying the colon dots (:) 81 and 83 of FIG. 6. While the display may be formed as a single integral assembly, in the preferred embodiment, stations 74, 76, 78, 80 and 190 are each formed separately and individually placed on the ceramic substrate 162 as illustrated in FIGS. 10 and 13. Photosensitive resistor 136 is also secured to the top of the substrate as are the transistor arrays 154 and 156.

Figure 14:
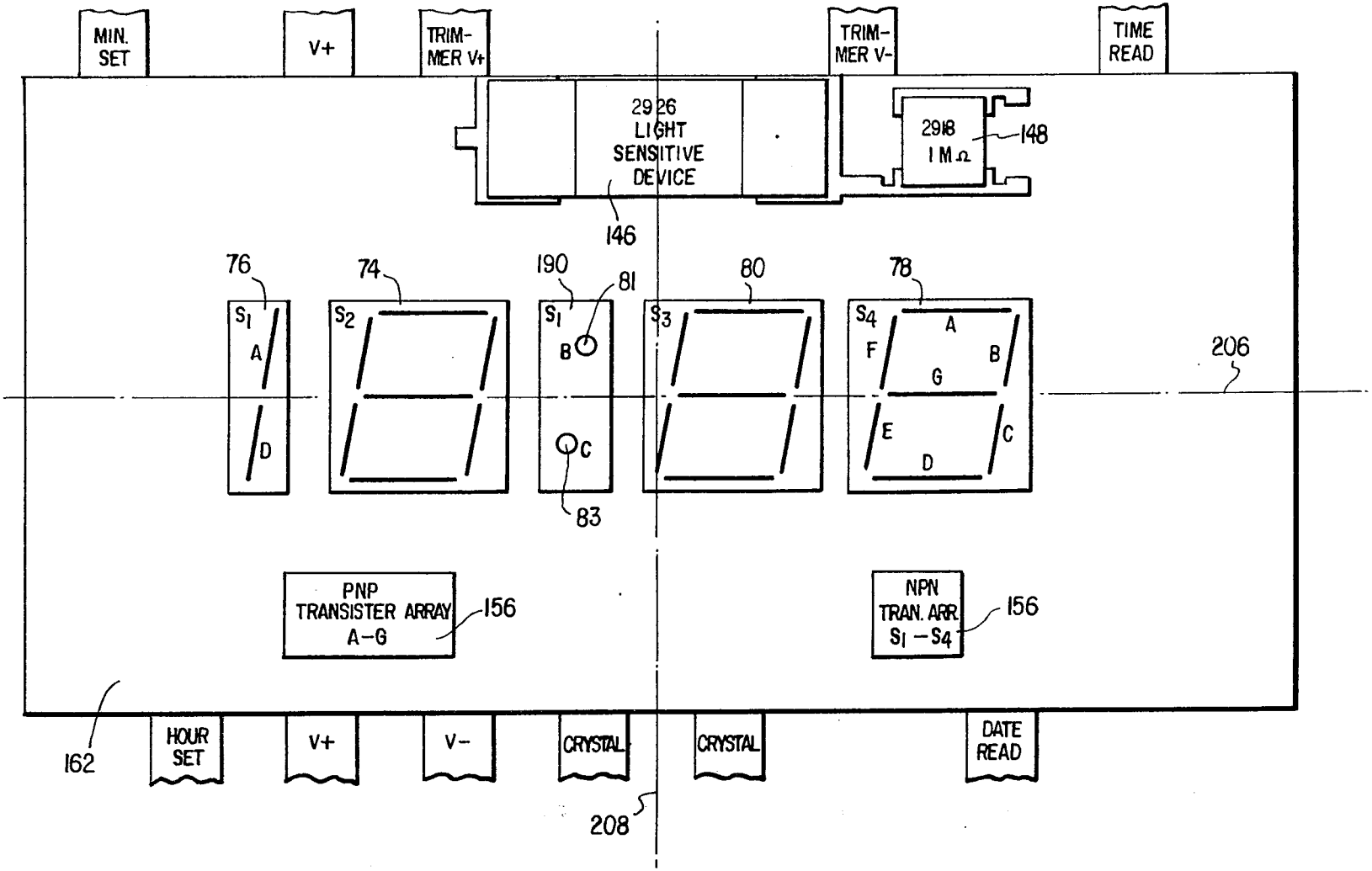
FIG. 14 is a top plan view of the light-emitting diode display module.
Figures 15, 16:
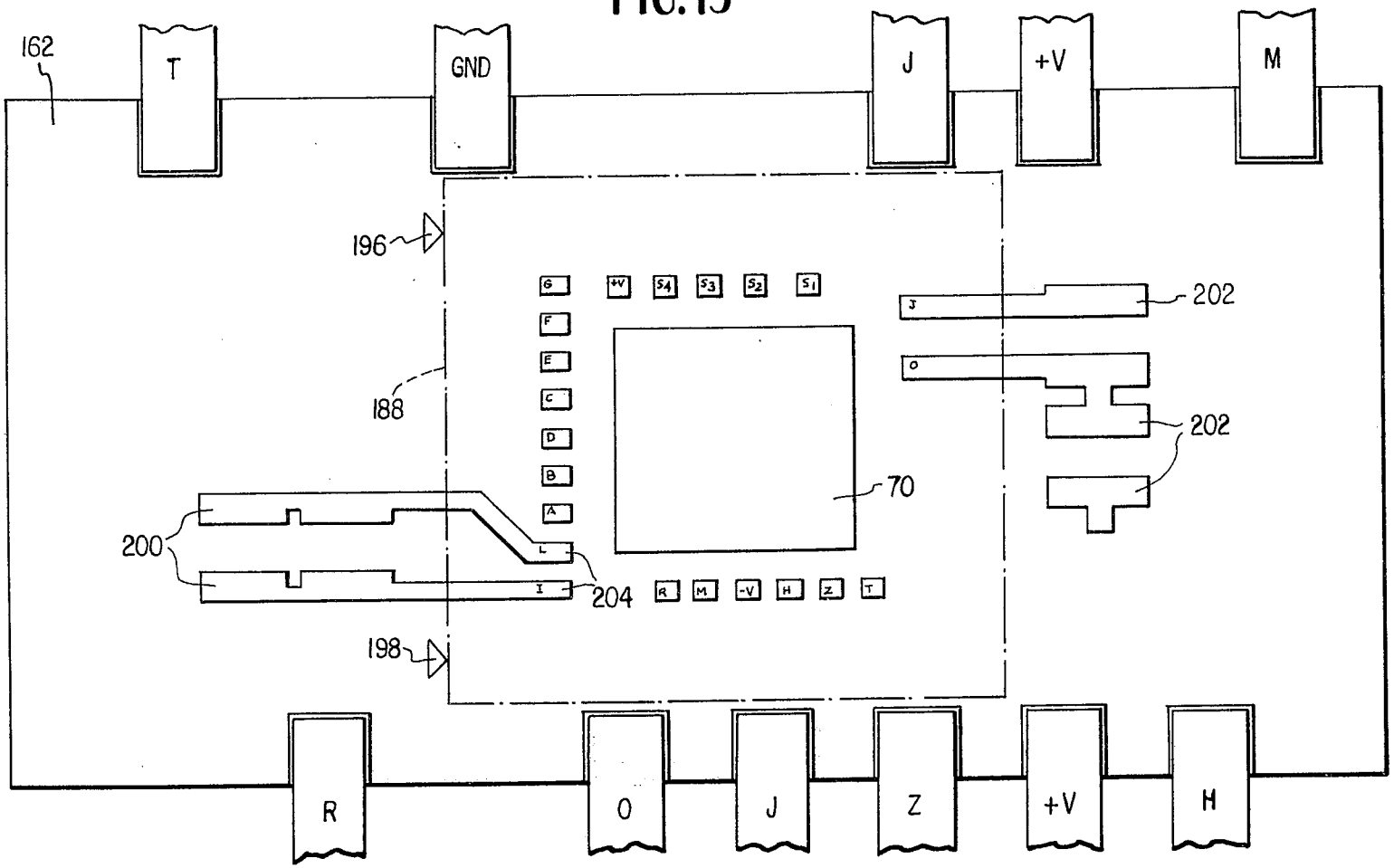
FIG. 15 is a bottom plan view of the display module of FIG. 14.
FIG. 16 is a side view of the multilayer ceramic substrate forming a part of the display module of FIGS. 14 and 15.

FIG. 14 is an enlarged top plan view of the ceramic substrate 162 with the display stations and associated circuitry mounted on top of it. FIG. 15 is a bottom plan view of the substrate showing the integrated circuit chip 70 mounted on its underside and FIG. 16 is a side view of the substrate showing its two-layer construction. The substrate is preferably made from two layers 192 and 194 (FIG. 16) joined by epoxy or the like and made of a suitable black ceramic material which carries on the top, bottom and one intermediate surface, printed electrical circuits, such as a suitable gold or gold alloy printed circuit eutectic bonded to the ceramic. The ceramic material of the layers 192 and 194 not only acts as a good physical support for the printed circuits, but provides excellent electrical insulation between the circuits. Interconnections between the circuits on the three surfaces are formed by electrical conductive pins (not shown) passing through the layers 192 and 194 to engage the printed circuits where electrical connections are made. For a more detailed disclosure of the display assembly including substrate 162, reference may be had to assignee's copending application Ser. No. 504,734, filed Oct. 10, 1974, the disclosure of which is incorporated herein by reference.

As seen to the enlarged scale in FIG. 14, the display stations 74, 76, 78, 80, and 190 are preferably formed as separate stations individually attached to substrate 162. However, if desired, the five stations may be constructed as a single unit attached to the top of the substrate. For the extremely small size necessitated by a ladies' wristwatch, it is preferred that the slightly smaller stations having the dimensions indicated in FIG. 14 be formed separately and separately attached to the substrate.

FIG. 15 shows the underside of substrate 162 and illustrates the large scale integrated circuit chip 70 as attached to the bottom surface. The outer dimensions of the dust cover 188 are indicated in phantom in FIG. 15 and the dust cover is positioned by the alignment marks 196 and 198. The various terminals of the substrate are labeled in FIG. 14 and these are connected by a conductive lead frame in the manner illustrated in FIG. 10 to the various switches, oscillator crystal, trimmer and battery terminals. A portion of the printed circuit on the underside or bottom surface of substrate 162 is illustrated at 200 and 202 in FIG. 15. Printed circuit leads 200 are illustrated as connected to a pair of bonding pads 204, it being understood that the integrated circuit chip 70 is wire bonded to these pads as previously described and illustrated at 184 and 186 in FIG. 11.

Figure 17:
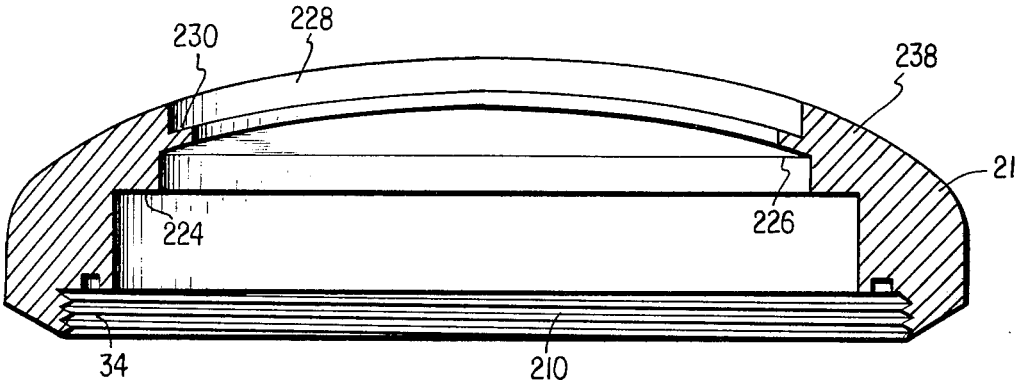
FIG. 17 is a vertical cross section along the three o'clock to nine o'clock plane of the ladies' wristwatch of FIG. 1.
Figure 18:
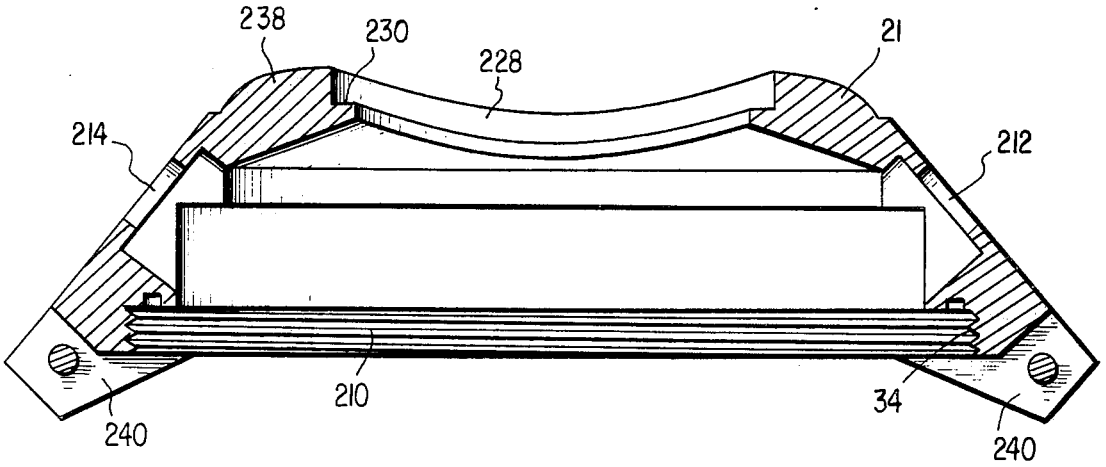
FIG. 18 is a vertical cross section along the 6 o'clock to 12 o'clock plane.
Figure 19:
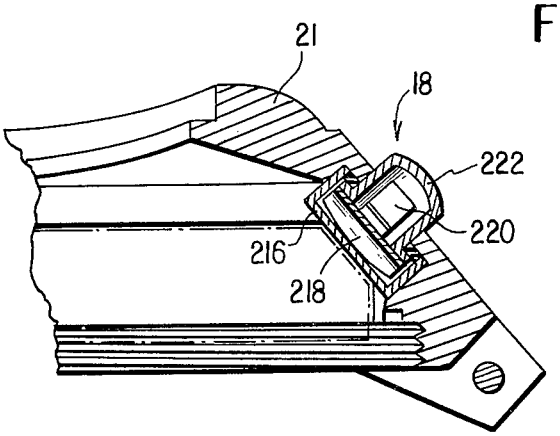
FIG. 19 is an enlarged cross section through a portion of the bezel of FIG. 18 showing one of the demand buttons.

FIG. 17 is a cross section through the case cover or bezel 21 of the ladies' wristwatch of FIG. 1. The cross section in FIG. 17 is in a vertical plane containing the three o'clock – nine o'clock axis of a conventional wristwatch, that is, it contains the centerline 206 of FIG. 14. FIG. 18 is a cross section through the bezel taken at right angles to that of FIG. 17, namely along the 6 o'clock –12 o'clock axis of a conventional wristwatch. It is on a vertical plane containing the perpendicular centerline 208 of FIG. 14. FIG. 19 is an enlarged cross-section of a portion of the bezel shown in FIG. 18 illustrating the pushbutton 18 which actuates the time demand switch 132.

As illustrated in FIGS. 17 and 18, bezel 21 is of circular configuration and contains a circular cavity 210 at its rear, which is provided with internal threads 34 for threaded engagement with the other edge of clamping ring 26 of FIGS. 2 and 4. In its wall, it is provided with a pair of apertures 212 and 214 which receive respectively, the assemblies forming the pushbuttons 18 and 20. Both pushbuttons are of identical construction and one is illustrated at 18 in FIG. 19. Briefly, it comprises a holder on pan 216 which closes off and permanently seals aperture 214. The pan supports an arcuately curved leaf spring 218 which in turn carries a permanent magnet 220. The magnet is enclosed within a cover 222 which acts as the pushbutton proper and when the button is pushed inwardly, spring 218 is deformed causing permanent magnet 220 which it carries to move inwardly so that its magnetic field influences and actuates the corresponding reed switch located adjacent the pushbutton 18 near the inside of pan 216. Reference may be had to assignee's copending application Ser. No. 481,331 filed June 20, 1974 for a more detailed description of the structure of pushbutton 18, the disclosure of which application is incorporated herein by reference.

Referring again to FIG. 17, the circular cavity 210 is stepped to form a seat 224 for the circular module frame 36 of FIG. 10. A second step 226 provides clearance for the display diodes and above this the bezel is provided with an elongated and curved opening 228 which forms the viewing window 14 of FIG. 1. This opening also is stepped to provide a seat 230 for a red light filter 232 illustrated in FIGS. 20 and 21. While filter 232 may be made of red ruby material or of a suitable red plastic, it is preferably made of a dark red hardened glass such as a type currently available from the Corning Corporation, identified as Type 2403 C.S. 2-58. The filter passes red light with a wavelength of 650 ± 20 Nanometers. The transmission is greater than 75% at this wavelength and is one percent or less at 600 Nanometers and below.

Figure 20:
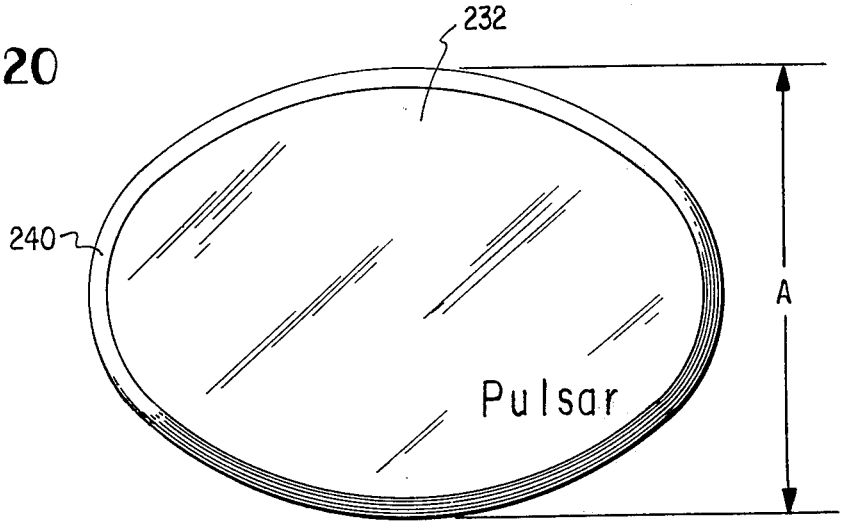
FIG. 20 is a top plan view of the red filter of the wristwatch of FIG. 1.
Figure 21:
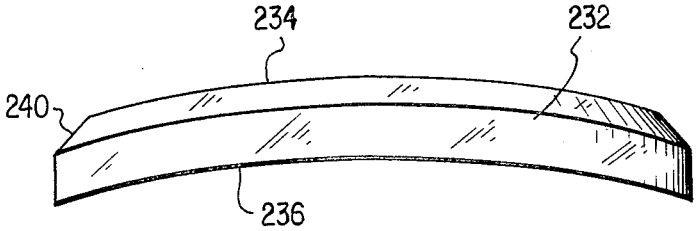
FIG. 21 is a side view of the filter of FIG. 20.

An important feature of the present invention resides in the fact that the filter 232, while of uniform thickness throughout, is of elongated or oblong shape as illustrated in FIG. 20 and has both parallel upper and lower surfaces arcuately curved, as illustrated in FIG. 21. It has been found that maintaining the radius of curvature of the two surfaces 234 and 236 of equal value so that the surfaces are parallel and with a curvature radius of no less than approximately 1.6 inches, the elongated configuration may be utilized to advantage with a minimum distortion and no loss in readability of the display diodes through the viewing window in which the filter is placed. To this end, the top surface 238 of the bezel, as illustrated in FIGS. 17 and 18, is similarly curved to conform to the shape of the filter 232 so that the edges of the filter terminate and the bezel begins in a smooth flowing and substantially uninterrupted curved contour. The top edge of the filter is tapered and preferably polished as at 240 and the filter is inserted into the bezel in FIG. 17 from the top whereby it rests on and is secured to the upper ledge 30. It is preferably bonded along its outer edge to the bezel by an epoxy adhesive or the like. Such a construction permits greater variation in the selection of pleasing designs so necessary for a ladies' wristwatch, but even more importantly makes optimum use of available space, thus permitting a smaller construction. For example, the width dimension, labeled A in FIG. 20, can be substantially reduced from previous relatively flat and substantially square or at least rectangular constructions to permit a smaller overall wristwatch case. Similarly, the curved configuration permits a reduction in the amount of material necessary for use in the wristwatch case, further reducing the overall size and weight of the ladies' wristwatch.

Figure 22:
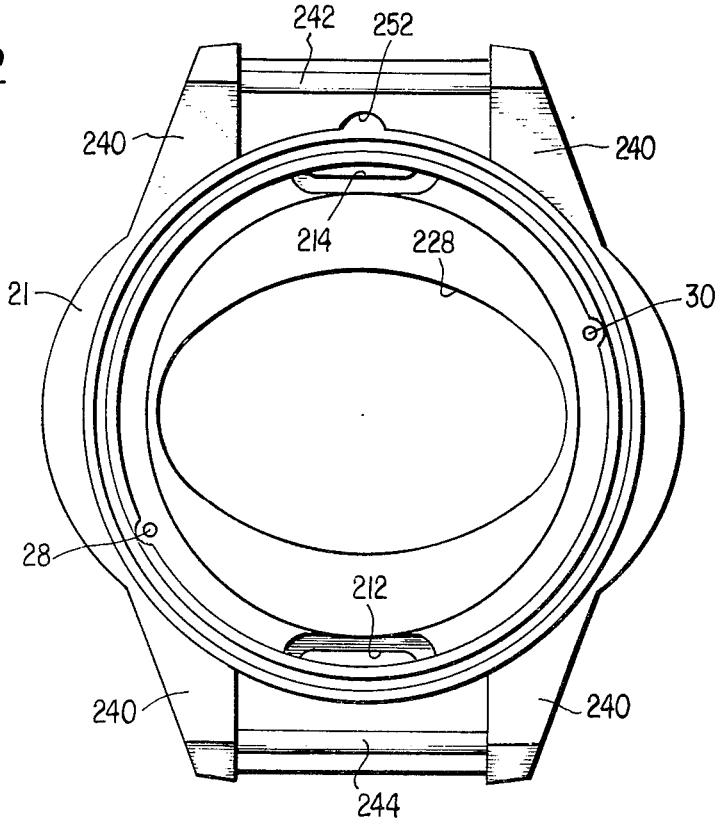
FIG. 22 is a bottom plan view of the watch case bezel of FIGS. 17 and 18.

FIG. 22 is a rear view of the bezel 21 of FIGS. 17 and 18 and shows the elongated or eliptical configuration of the opening 228 which receives the filter 232. The bezel is provided with projections 240 supporting the ends of the spaced rods 242 and 244 for attaching the bezel or wristwatch case to a suitable wrist band or bracelet such as that illustrated at 16 in FIG. 1.

Figure 23:
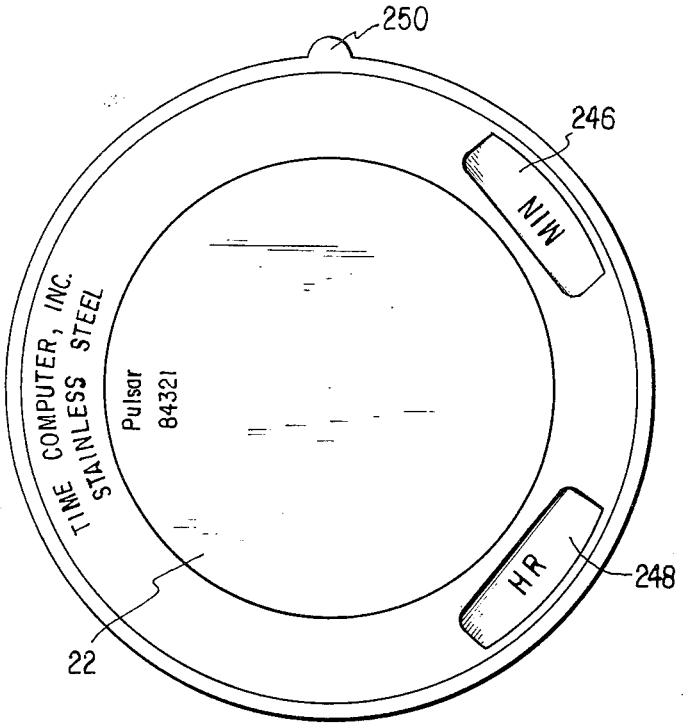
FIG. 23 is a view of the watch case back as it appears from outside the wristwatch.

FIG. 23 is a plan view of the outside or back surface of the backplate 22 of the wristwatch. It is provided with indentations 246 and 248 labeled MIN (for minutes) and HR (for hours), respectively. These indentations in the assembled watch are located near the respective minute set switch 134 and hour set switch 136, so that when a permanent magnet (not shown) is inserted into one of the indentations 246 or 248, the appropriate setting switch is actuated. The backplate is aligned with the module by means of a projection 250 received in a corresponding bezel recess 252 shown in FIG. 22.

FIG. 24 is a plan view of the inside of the backplate 22 of FIG. 23, and FIG. 25 is a partial cross section taken along line 25—25 of FIG. 24. The two battery cells 712 and 714 of FIG. 3 are connected in series by a cell connector 254 which is soldered as at 256, or otherwise suitably secured to the inside of the backplate 22. Connector 252 is made of electrically conductive and resilient spring metal and is cut out as at 258 and 260 in FIG. 24 to define a pair of oppositely directed and upwardly extending resilient contact arms 262 and 264 in FIG. 25 which, when the cover is secured in place, resiliently engage the respective battery cells 712 and 714 connecting the two 1½ volt cells in series to form a nominal 3-volt wristwatch battery power supply.

It is apparent from the above that the present invention provides an improved wristwatch which, while of simplified and inexpensive construction, most importantly can be made in the small size necessary to form an attractive ladies' wristwatch, and by way of example only, may take up approximately one-half of the total volume of the man's wristwatches of this type presently on the market. The entire module of FIG. 10 is preferably completely enclosed in a potting compound, such as by being coated with a transparent lacquer or epoxy to render the entire unitary module completely enclosed and substantially impervious to the elements. The watch is easy to assemble, requiring a minimum of electrical connections and is reliable in operation. For the first time, it permits the construction in a very small space suitable for use as a ladies' wristwatch, a timepiece that exhibits substantially the same accuracy, reliability and other desirable timekeeping features which heretofore have been only available in the much larger sizes man's wristwatch.

Important features of the present invention include the compactness of both the electronics and the watch case construction. This is made possible in part by the provision of a novel curved light filter which, in addition to conserving space, gives a flexibility of curved line design so that a more attractive and more ornamental product results consistent with the historical approach to a ladies' wristwatch. In one embodiment constructed in accordance with the present invention, the overall diameter of the module illustrated in FIG. 10 was 1.00 ± 0.002 inch and the overall thickness of the module as viewed in FIG. 11 was 0.295 inch. This movement was placed in a watch bezel of the type illustrated in FIG. 22 having an overall length (long dimension) of 1.26 inch; an overall width of 1.32 inch (excluding arms 240) and an overall thickness of 0.54 inch.

The invention may be embodied in other specific forms without departing from the spirit or essential characteristics thereof. The present embodiment, is, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed and desired to be secured by United States Letters Patent is:

1. A solid state wristwatch comprising a watch case, an electrically insulating frame mounted in said case, an electrically insulating substrate carried by said frame, a plurality of electro-optical digital display stations on one side of said substrate, a combination time and calendar integrated circuit chip on the other side of said substrate and electrically coupled to said display stations, said watch case including a viewing window adjacent said display stations elongated along the three o'clock – nine o'clock axis of said wristwatch, and a band pass optical filter in said window, said filter being arcuately curved about only one axis, which axis lies in the conventional 6 o'clock to 12 o'clock vertical plane through the center of the wristwatch.

2. A solid state ladies' wristwatch comprising a watch case, an electrically insulating frame mounted in said case, an electrically insulating ceramic substrate carried by said frame, a plurality of light emitting diode digital display stations on one side of said substrate, a combination time and calendar integrated circuit chip on the other side of said substrate, manually operated demand switch means coupling said circuit chip to said display stations for actuating said display stations upon demand by the wristwatch wearer, said watch case including a viewing window adjacent said display stations elongated along the conventional three o'clock – nine o'clock axis of said wristwatch, and a band-pass optical filter in said window, said filter being arcuately curved about only one axis, which axis lies in the conventional 6 o'clock to 12 o'clock vertical plane through the center of the wristwatch.

3. A wristwatch according to claim 1 wherein said filter passes a narrow band of red light.

4. A wristwatch according to claim 3 wherein said filter passes light having a wavelength centered at approximately 650 nanometers.

5. A wristwatch according to claim 3 wherein said filter blocks at least 99 percent of the light at a wavelength of approximately 600 nanometers and below.

6. A wristwatch according to claim 3 wherein said filter passes at least 75 percent of the light having a wavelength from about 630 nanometers to about 670 nanometers.

7. A wristwatch according to claim 1 wherein the portions of said watch case adjacent said filter are similarly curved to form a substantially smooth continous outer surface with said filter.

8. A wristwatch according to claim 1 wherein said display stations are individually secured to said substrate.

9. A ladies' wristwatch according to claim 2 wherein the radius of curvature of said filter is greater than about 1.6 inches.

10. A ladies' wristwatch according to claim 9 wherein the portions of said watch case adjacent said filter are similarly curved to provide a substantially continuous, uninterrupted smooth outer surface in conjunction with said filter.

11. A ladies' wristwatch according to claim 9 wherein said filter is made of hardened glass.

12. A ladies' wristwatch according to claim 9 wherein said filter is red.

13. A ladies' wristwatch according to claim 9 wherein the pass band of said filter is above 600 nanometers in wavelength.

14. A ladies' wristwatch according to claim 9 wherein said light emitting diode display stations are individually secured to said substrate.

15. A ladies' wristwatch according to claim 14, wherein said stations include hours and minutes stations for displaying the hours and minutes of time in decimal number form.

16. A ladies' wristwatch according to claim 15 including an intermediate station between said hours and minutes stations for displaying a pair of colon dots.

17. A ladies wristwatch according to claim 16 including a first manually operated time demand switch and a second manually operated calendar demand switch coupling said circuit chip to said display stations for selectively displaying time and calendar information on said stations.

18. A ladies wristwatch according to claim 17 including means for displaying AM and PM information on th colon dots of said intermediate station when the calendar one of said demand switches is actuated.

* * * * *